US006158677A

United States Patent [19]

Coles

[11] Patent Number: 6,158,677

[45] **Date of Patent: *Dec. 12, 2000**

[54] POWER WASHER WAND

[75] Inventor: Charles Coles, 25 Hollywood Ave., Massapequa, N.Y. 11758

[73] Assignee: Charles Coles, Massapequa, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,311

[22] Filed: Aug. 18, 1997

[51] Int. Cl.[7] ..... B05B 7/02

[52] U.S. Cl. ..... 239/526; 239/530; 239/587.1

[58] Field of Search ..... 239/302, 337, 239/447, 525, 526, 530, 532, 456, 458, 587.1, 587.5, 588, 270, 280, 587.2, 587.3; 138/DIG. 11, 26, 177; 285/81, 305, 319

[56] References Cited

U.S. PATENT DOCUMENTS

| | | | |
|---|---|---|---|
| 1,779,177 | 10/1930 | Long | 239/587.2 |
| 2,464,366 | 3/1949 | Bakke | 239/279 |
| 3,023,971 | 3/1962 | Milhous | 239/587.1 |
| 3,410,493 | 11/1968 | Bion-Biro | 239/587.3 |
| 3,940,072 | 2/1976 | Ishikawa | 239/525 |
| 4,043,397 | 8/1977 | Glowienke | 239/532 |
| 4,216,911 | 8/1980 | Huperz | 239/526 |
| 4,570,854 | 2/1986 | Wernhart | 239/280 |
| 4,915,419 | 4/1990 | Smith, III | 285/305 |
| 5,725,322 | 3/1998 | Evans | 239/532 |
| 5,749,526 | 5/1998 | Laabs et al. | 239/532 |

OTHER PUBLICATIONS

Kurtz Manufacturing, Inc. Brochure, pp. 7–8, "Telescopic Wands" and "Extension Wand Kit" (date unknown).

Water Cannon Product Catalog, p. 5, "Telescopic Wand", (date unknown).

*The Fire Chief's Handbook,* pp. 348–349 (date unknown).

*Primary Examiner*—Andres Kashnikow
*Assistant Examiner*—Dinh Q. Nguyen
*Attorney, Agent, or Firm*—Proskauer Rose LLP

[57] ABSTRACT

A power washer wand has a loop or helix which balances the forces of the water stream. By balancing these forces, the back pressure is greatly reduced. This results in less fatigue for the user and also enables the wand to be extended in order to reach high or distant surfaces without the use of a ladder or scaffold. The wand may also include a universal joint. This joint allows the angle between the wand nozzle or tip and the surface being washed to remain substantially constant. The wand may be longer than conventional wands and may be connected to an extension.

14 Claims, 4 Drawing Sheets

POWER WASHER WAND

BACKGROUND OF THE INVENTION

1. Field of the Invention

The present invention relates to an improved power washer wand and, more particularly, to a power washer wand having a loop which greatly reduces the back pressure exerted on the user.

2. Discussion of Related Art

Power washing, or pressure washing, is commonly used in the maintenance of buildings and other exterior surfaces. Power washing is typically performed using a device such as is seen in FIG. 1. A power washing machine 5 typically includes a pump 7 connected to a water source 9, and a wand 11 which is connected to the pump 7 by a hose 13. The power washer user holds the power washer wand 11 and activates a trigger 15 to expel from a nozzle or tip 17 a highly pressurized water stream against a surface. This highly pressurized water stream is typically used to remove dirt, mildew, and other unwanted substances from a surface.

One well-known drawback of power washing is the back pressure exerted from the highly pressurized water stream to the user. This back pressure has several drawbacks.

A first drawback is that the back pressure prevents the user from standing on the ground and extending his arms to reach high or distant surfaces. The pressure exerted from the surface and through the wand increases exponentially as it extends down a straight line. If a user extends his arm to wash a distant surface, the force from the water against the surface to the user's shoulder is much greater than, for example, the force from the surface to the user's elbow. Note that the pressure of the water stream against the surface may exceed 2000 $lb/in^2$ and the distance from the surface to the user's shoulder (i.e., has extended his arm) may exceed 6 feet. Thus, the pressure exerted on the user's shoulder may be great. Consequently, the user may need to erect a scaffold or ladder from which distant surfaces may be reached without the user extending his arm. This is inconvenient, time consuming—and expensive if a ladder or scaffold is not available. Moreover, this is dangerous. The back pressure exerted by the water stream may cause the user to fall from the ladder or scaffold. In some cases, some surfaces may not be reached even if a ladder or scaffold is used.

A second drawback is that the back pressure limits the size of the wand. Because the straight length from the surface through a straight line exponentially increases the force on the user, a long wand is difficult to operate. Thus, a wand for use with a high pressure nozzle cannot be made longer than several feet because the pressure from the surface being power washed to the user's elbow (or even to the trigger) is too great for convenient use. Similarly, a wand for use with a high pressure nozzle cannot be connected to an extension, again because the forces on the user holding the proximal end of the wand/extension combination are too great.

A typical wand 11 is connected to the hose 13 using a conventional "quick coupler" 19. If an extended wand was constructed of a number of portions connected using only conventional quick couplings, the extension would not be safe. This is because the back pressure exerted on the couplings would greatly stress the couplings and could result in the extension breaking during use. Telescopic wands are known. However, these telescopic wands are intended for use only with low pressure nozzles. For example, a low pressure nozzle may have a 25° "fan out". As seen in FIG. 2A, a tip 17' having a large "fan out" distributes the water W along a large area of the surface being cleaned. As a result, the pressure against the surface is reduced. At the same time, the effectiveness of the power washer to remove unwanted substances from the surface is also reduced. On the other hand, as seen in FIG. 2B, nozzles having little or no "fan out", such as a 0° nozzle 17", focus all of the water stream's pressure on a small area of the surface being cleaned and thus are more effective at removing unwanted substances from the surface. For the reasons described above, however, a telescopic wand cannot practically be used with a high pressure nozzle.

A third drawback is that the back pressure tends to fatigue the user. The user exerts energy against this back pressure in order to hold the wand 11 steady.

Therefore, it is an object of the present invention to provide a power washer wand which reduces the back pressure caused by the water stream.

It is a further object of the present invention to provide a power washer which may be used to reach distant surfaces without the use of a scaffold or ladder.

It is yet a further object of the present invention to provide a power washer wand which may have an extended length without any compromise in nozzle pressure.

It is an even further object of the present invention to provide an improved extended wand.

SUMMARY OF THE INVENTION

These and other objects of the present invention are provided by a power washer wand having a loop or helix which balances the forces of the water stream. By balancing these forces, the back pressure is greatly reduced. This results in less fatigue for the user and also enables the wand to be extended in order to reach high or distant surfaces without the use of a ladder or scaffold. The wand may also include a universal joint. This joint allows the angle between the wand nozzle or tip and the surface being washed to remain substantially constant. The wand may be longer than conventional wands and may be connected to an extension without any compromise of nozzle pressure.

BRIEF DESCRIPTION OF THE DRAWINGS

The present invention is described with reference to the following figures.

DETAILED DESCRIPTION OF PREFERRED EMBODIMENTS

Figure 1:
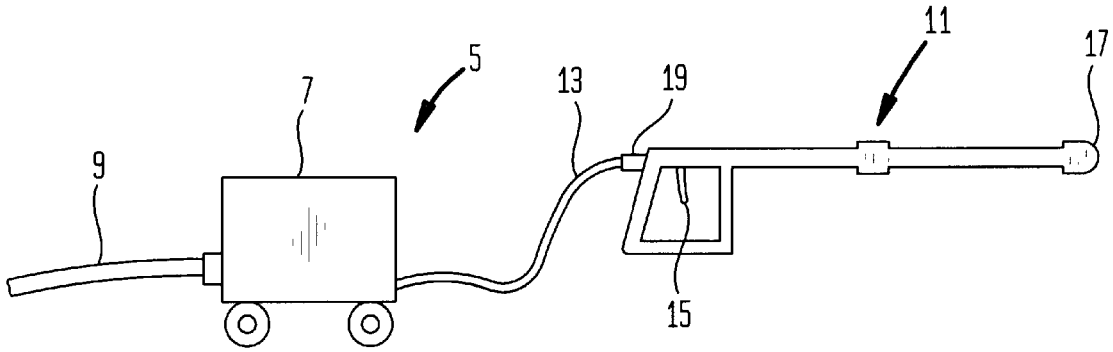
FIG. 1 (PRIOR ART)
FIG. 1 illustrates a conventional power washing machine.
Figure 2A:
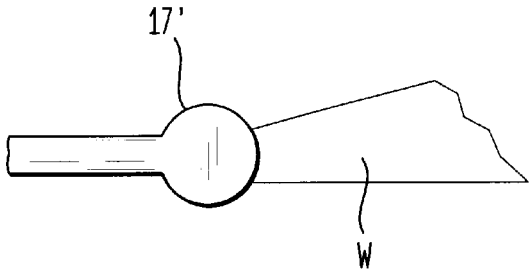
FIG. 2A (PRIOR ART)
FIG. 2A illustrates a power washer nozzle having reduced pressure against a surface due to a "fan out"
Figure 2B:
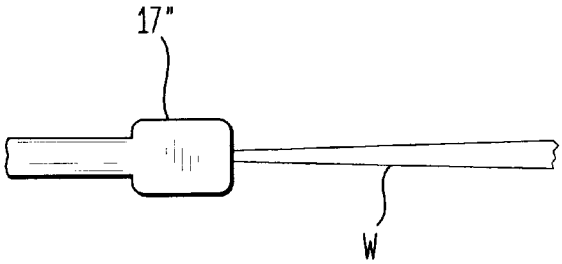
FIG. 2B (PRIOR ART)
FIG. 2B illustrates a power washer nozzle having no "fan out"
Figure 3A:
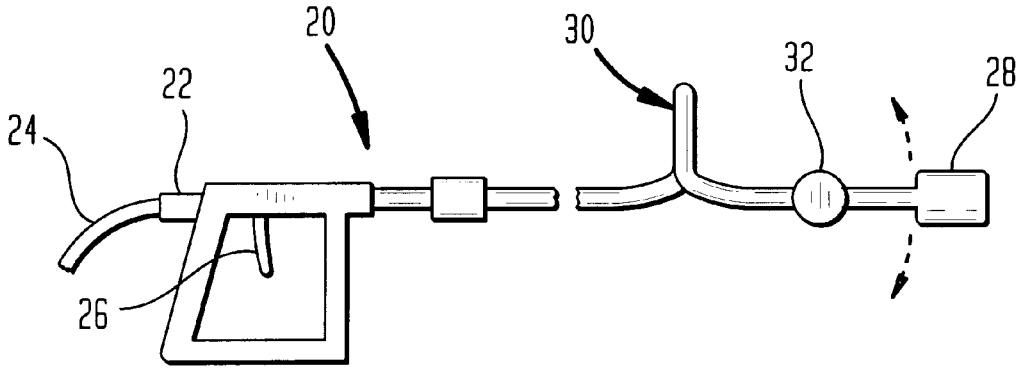
FIG. 3A is a side elevational view of a power washer wand according to a preferred embodiment of the present invention.
Figure 3B:
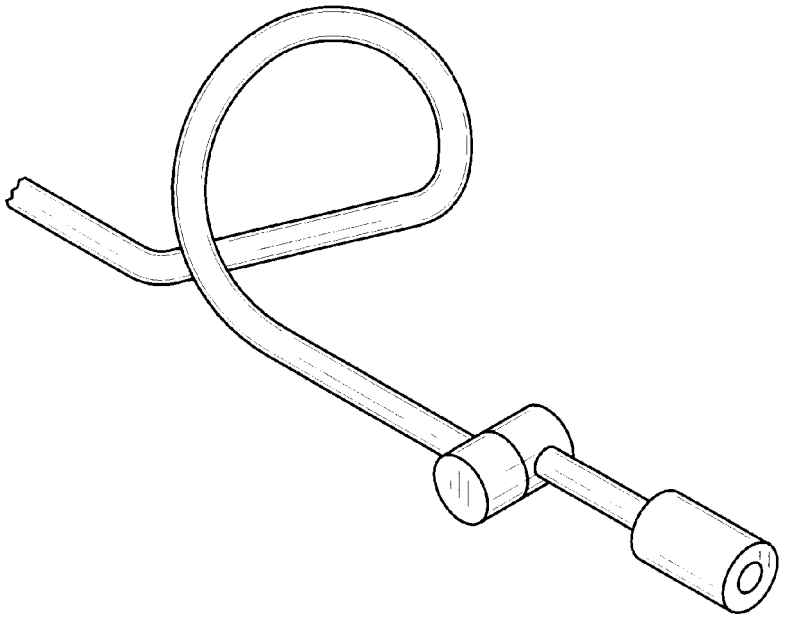
FIG. 3B is an isometric view of a power washer wand according to a preferred embodiment of the present invention.
Figure 3C:
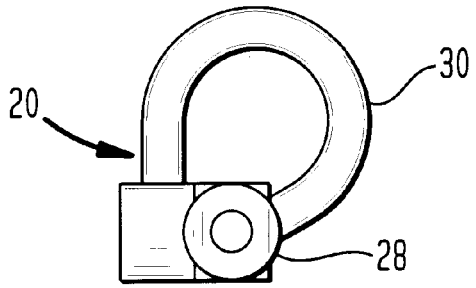
FIG. 3C is a front elevational view of a power washer wand according to a preferred embodiment of the present invention.

FIGS. 3A, 3B, and 3C illustrate a first preferred embodiment of a power washer wand 20 according to the present invention. The power washer wand 20 of FIGS. 3A–C has a quick coupling 22 which detachably connects the wand to a hose 24. The power washer 20 also has a trigger 26 of the conventional type. Located between the trigger 26 and the nozzle or tip 28 of the wand is a loop or helix 30. Preferably, the loop 30 is located at a position which is slightly proximal from the nozzle, such as between several inches to a foot behind the nozzle 28.

The loop 30 preferably has a turn which brings the water stream back over itself. Most preferably, the turn is 270°. This loop 30 balances the vector forces caused by the pressurized water stream against the surface being power washed.

Referring to FIG. 3A, the wand may optionally be provided with a universal joint 32. This universal joint 32 permits the wand nozzle 28 to be adjusted to a desired angle. The movement of the nozzle is illustrated by the dashed lines. It was found that during use of the inventive wand, if the angle between the wand nozzle 28 and the surface being washed fell outside of a desired range of angles between about 0° and 45° with respect to horizontal, the back pressure was no longer reduced. Thus, the universal joint 32 is provided to maintain the desired range of angles between the wand nozzle 28 and the surface being washed.

Figure 4B:
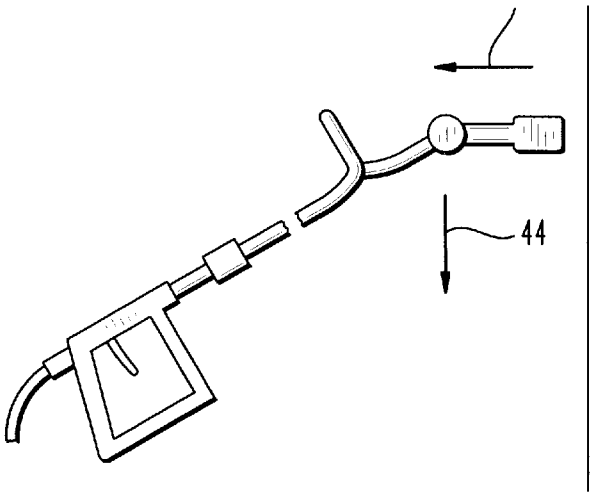
FIG. 4B illustrates how the present invention may neutralize the force experienced by the user due to the weight of the inventive power washer nozzle.
Figure 4A:
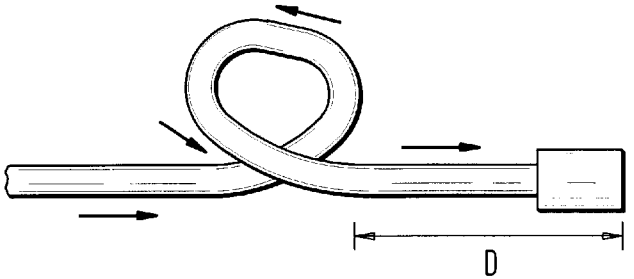
FIG. 4A illustrates a theory of the operation of the present invention.

A theory regarding the operation of the present invention is provided in FIG. 4A. The arrows indicate vector forces (the back pressure forces are not shown). The inventor believes the advantages of the present invention may be realized because the overall straight length of the forces in the plane of the trigger to the nozzle are interrupted by the vector forces in the loop 30. Thus, the force from the stream against the surface being washed is exponentially increased only for the distance from the surface to the distal portion of the loop 30. This distance is designated by D in FIG. 4A. Note that distance D is significantly shorter than the distance from the surface to the trigger, the user's elbow, and the user's shoulder. It is believed that the reduction of the overall straight length of the forces from the surface to the wand are greatly reduced, as a result the back pressure forces on the user are correspondingly exponentially reduced. It is also possible that when the water stream flows back over itself, a portion of the water pressure is canceled by forces in the opposite direction.

FIG. 4B illustrates how the present invention may reduce or neutralize the force of the weight of the inventive power washer wand experienced by the user. When the nozzle is at an angle with the surface being cleaned, such as at a 45° angle with respect to a surface over the user's head, the back pressure may be reduced due to the forces between the surface, the nozzle, and the loop. As seen in the example provided in FIG. 4B, the horizontal back pressure 42 may reduce the downward force 44, thus reducing the force experienced by the user due to the weight of the wand.

Figure 5:
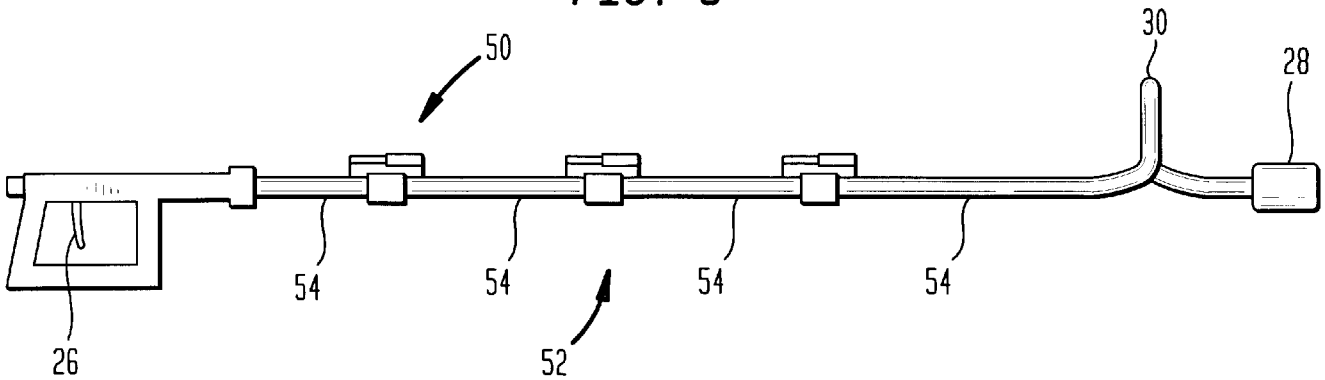
FIG. 5 illustrates a power washer wand according to a preferred embodiment of the present invention wherein the wand has an extended length.

As seen in FIG. 5, the reduction in back pressure due to the inventive wand permits a power washer wand 50 having an extended length without compromising nozzle pressure. In FIG. 5, the loop 30 may be included in an extension wand 52 which may detachably connect to a trigger 26 or the end of a conventional wand. As described in more detail below, the extension wand 52 may comprise a number of connected portions 54. This extended wand permits a user to reach distant surfaces with a much more powerful tip than was previously possible. The present invention may reach surfaces which previously could only be reached using a ladder or scaffold and surfaces which may not have been accessible even with a ladder or scaffold.

Figure 6:
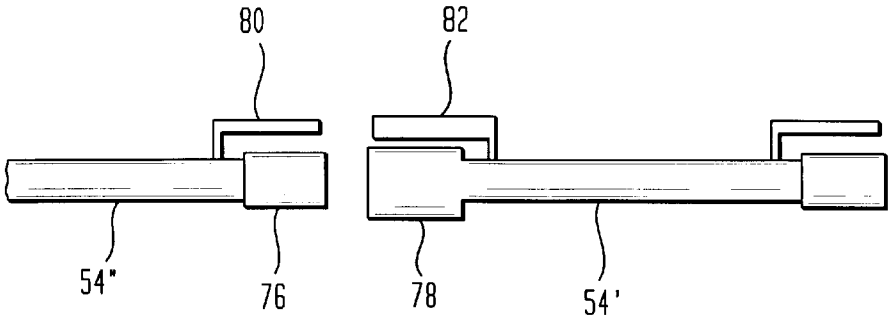
FIG. 6 illustrates two portions of a power washer wand extension according to a preferred embodiment of the present invention.

FIG. 6 illustrates two portions 54', 54" of a power washer wand extension according to a preferred embodiment of the present invention. Note that the two portions are connected by conventional quick couplers 76, 78. In addition, however, each portion 54', 54" is provided with an external male/female coupler 80, 82. These external couplers preferably have a substantial overlap. The external couplers provide rigidity to the extension as well as align the portions to provide a straight conduit for the water stream. These couplers permit a wand of a desired length to be assembled quickly and easily, yet provide a rigid and straight wand.

Figure 7:
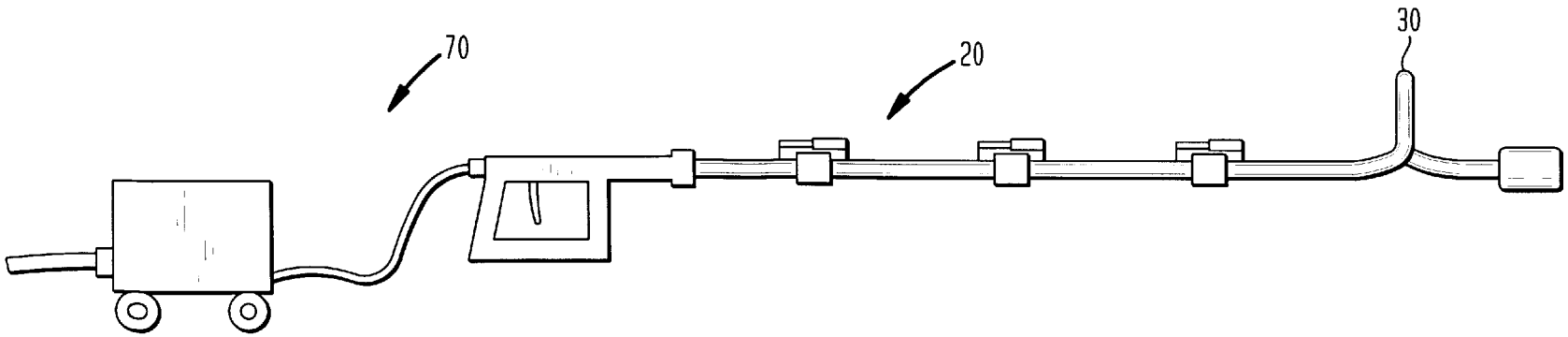
FIG. 7 illustrates a power washer having a wand according to a preferred embodiment of the present invention.

FIG. 7 illustrates a power washer 70 having a wand 20 according to the present invention.

The inventive power washer may be attached to a long extension that may reach over 10 feet away from the user. The inventive wand also permits accurate maneuvering of a high pressure tip (such as 2400 lbs at the tip). The inventive power washer wand greatly improves on prior known power washer wands. By reducing the back pressure: (1) the wand may be extended to increase the reach of the wand; (2) the user may extend his arm in order to reach high or distant surfaces; (3) the user operates in greater safety because the user may stand on the ground; and (4) the user is less fatigued. The first two advantages permit power washing distant areas without the aid of a ladder or a scaffold. By eliminating the scaffold and/or ladder, the power washing process becomes significantly less expensive and less time consuming. Even if a ladder or scaffold is used, the present invention is safer to use than a conventional wand, due to the reduced back pressure. Moreover, by remaining on the ground, rather than on a ladder or scaffold, the power washing process becomes significantly safer. Also, an extension allows power washing of surfaces which may be inaccessible even when using a ladder or scaffolding to be reached without loss of cleaning pressure. Yet another advantage is that a power washing job which previously had been performed by more than one person may now be performed by a single person.

The inventor has also noted that the present invention has the following advantages over prior known wands, including the prior known telescopic wands. A power washing job which previously took seven hours to complete takes only three hours using the present invention. Moreover, the job is done at a higher quality. This is because the user operates at a distance from the surface being cleaned, and this allows the user to view the surface from this distance. Viewing from a distance allows the user to be more "critical" of the thoroughness of the work and allows a more uniform appearance. Thus, a job may be completed in half the time and with better results than previously possible. Moreover, ladders and scaffoldings may be avoided. This results in further time and money savings and well as greatly increased safety.

The above described embodiments of the invention are intended to be illustrative only. Numerous alternative embodiments may be devised by those skilled in the art without departing from the spirit and scope of the following claims.

I claim:

1. A power washer wand, comprising:

a. a first end configured to receive a pressurized stream;

b. a nozzle configured to expel the pressurized stream;

c. a loop having a turn which is greater than 180° located proximal to the nozzle; and d. a universal joint on the wand to configured change an angle of the nozzle.

2. The wand of claim 1, wherein the universal joint is configured to allow an angle of the nozzle to remain constant with respect to a surface being washed.

3. The wand of claim 1, wherein the universal joint is connected between the loop and the first end.

4. The wand of claim 1, wherein the first end further comprises a plurality of extension portions, each of the plurality of extension portions having conventional couplings for fluid connection and external couplings configured to provide at least one of rigidity and alignment.

5. The wand of claim 4, wherein the external couplings further comprise:

a. a male coupler at a first end of a first extension portion;

b. a female coupler at a second end of the first extension portion;

c. the male coupler configured selectively to connect to a female coupler on another of the plurality of extension portions; and d. the female coupler configured selectively to connect to male coupler on another of the plurality of extension portions.

6. The wand of claim 4, wherein the nozzle is a high pressure nozzle.

7. The wand of claim 4, wherein the nozzle has no fan out.

8. The wand of claim 4, wherein the nozzle is a 0° nozzle.

9. An extendable power washer wand, comprising:

a. a first end configured to receive a pressurized stream, the first end having a plurality of extension portions, each of the plurality of extension portions having conventional couplings for fluid connection and external couplings configured to provide at least one of rigidity and alignment.

b. a nozzle configured to expel the pressurized stream; and c. a helix having a turn which is greater than 180° located in the wand between the first end and the nozzle.

10. The extendable power washer wand of claim 9, wherein the first end comprises a plurality of extension portions and the external couplings further comprise:

a. a male coupler at a first end of a first extension portion;

b. a female coupler at a second end of the first extension portion;

c. the male coupler configured selectively to connect to a male coupler on another of the plurality of extension portions; and d. the female coupler configured selectively to connect to a male coupler on another of the plurality of extension portions.

11. The extendable power washer wand of claim 9, wherein the nozzle is a high pressure nozzle.

12. The extendable power washer wand of claim 9, wherein the nozzle has no fan out.

13. The extendable power washer wand of claim 9, wherein the nozzle is a 0° nozzle.

14. A power washer, comprising:

a. a pump;

b. a hose connected to the pump; and c. a wand connected to the hose, the wand having:

(1) a first end configured to receive a pressurized stream;

(2) a nozzle configured to receive a pressurized stream; and (3) a helix located proximal to the nozzle; and (4) a universal joint configured to change an angle of the nozzle.

* * * * *